US012150494B2

(12) United States Patent
Towns-Scott

(10) Patent No.: US 12,150,494 B2
(45) Date of Patent: Nov. 26, 2024

(54) MENSTRUAL GARMENT

(71) Applicant: Honor Your Flow, Chicago, IL (US)

(72) Inventor: Cecelia Towns-Scott, Chicago, IL (US)

(73) Assignee: Honor Your Flow, Chicago, IL (US)

( * ) Notice: Subject to any disclaimer, the term of this patent is extended or adjusted under 35 U.S.C. 154(b) by 79 days.

(21) Appl. No.: 17/992,629

(22) Filed: Nov. 22, 2022

(65) Prior Publication Data

US 2023/0157376 A1 May 25, 2023

Related U.S. Application Data

(60) Provisional application No. 63/282,484, filed on Nov. 23, 2021.

(51) Int. Cl.

| | |
|---|---|
| ***A41B 9/00*** | (2006.01) |
| ***A41B 9/04*** | (2006.01) |
| ***A41D 31/10*** | (2019.01) |

(52) U.S. Cl.

CPC ..... *A41B 9/004* (2013.01); *A41B 9/005* (2013.01); *A41B 9/04* (2013.01); *A41D 31/10* (2019.02)

(58) Field of Classification Search

CPC ..... A41B 9/004; A41B 9/005; A41B 9/04

See application file for complete search history.

(56) References Cited

U.S. PATENT DOCUMENTS 1,926,911 A * 9/1933 Manny ..... A41B 9/04 D2/712
2,255,931 A * 9/1941 Kloster ..... A41B 9/02 2/404
2,435,945 A * 2/1948 Redmond ..... A41B 9/04 D2/712
2,494,292 A * 1/1950 Frazer ..... A61F 13/72 604/397

(Continued)

FOREIGN PATENT DOCUMENTS

EP 3437604 A1 * 2/2019
EP 4159175 A1 * 4/2023 ..... A61F 13/476

(Continued)

OTHER PUBLICATIONS

Period Aisle, retrieved from the Internet at https://periodaisle.com/pages/our-tech, on May 19, 2023 (available prior to Nov. 23, 2021)(15 pages).

(Continued)

*Primary Examiner* — Khaled Annis

(74) *Attorney, Agent, or Firm* — Neal, Gerber & Eisenberg LLP

(57) ABSTRACT

Embodiments include a washable garment, comprising a main portion configured to be worn on a lower body of a wearer, the main portion comprising an outer fabric layer, a gusset layer, and an inner fabric layer, each layer having a substantially similar length; and a removable portion coupled to the main portion between the inner fabric layer and the gusset layer, the removable portion configured to (Continued)

absorb fluids while worn against the lower body of the wearer, wherein the inner fabric layer includes an opening for receiving the removable portion therethrough, and the removable portion is sized and shaped to extend substantially across a length and width of the gusset layer.

10 Claims, 5 Drawing Sheets

(56) References Cited

U.S. PATENT DOCUMENTS 2,985,170 A * 5/1961 Title ..... A61F 13/72 604/397
4,044,769 A * 8/1977 Papajohn ..... A61F 13/76 604/397
4,301,550 A * 11/1981 Carver ..... A41B 9/005 2/408
5,330,598 A * 7/1994 Erdman ..... A61F 13/49473 156/229
5,593,398 A * 1/1997 Weimer ..... A61F 13/74 604/360
5,944,708 A 8/1999 Philpott
6,393,621 B1 * 5/2002 Redwine ..... A61F 13/49017 2/400
6,502,250 B2 * 1/2003 Suga ..... A61F 13/49 604/385.02
6,807,685 B1 * 10/2004 Hasegawa ..... A61F 13/505 2/400
7,745,684 B2 * 6/2010 Huza ..... A41B 9/00 604/367
7,951,128 B1 * 5/2011 Lewis ..... A61F 13/47236 604/394
8,051,495 B2 * 11/2011 Lee ..... A41B 9/12 2/400
8,935,813 B2 * 1/2015 O'Leary ..... A41B 9/001 2/400
9,931,561 B2 * 4/2018 Zakem ..... A41D 1/08
10,463,085 B2 * 11/2019 McGargill ..... A41D 27/201
10,986,877 B2 * 4/2021 Kimel ..... A41B 9/023
11,375,756 B1 * 7/2022 White ..... A41B 17/00
11,395,774 B2 * 7/2022 Skinner ..... A61F 13/539
11,612,191 B1 * 3/2023 White ..... A41B 9/004 2/400
11,737,931 B2 * 8/2023 Griffiths ..... A61F 13/15268 604/378
2001/0020158 A1 * 9/2001 Nozaki ..... A61F 13/505 604/397
2005/0090796 A1 * 4/2005 Coleman ..... A61F 13/49012 604/387
2010/0269243 A1 * 10/2010 Paree ..... A41B 9/005 2/243.1
2011/0172621 A1 * 7/2011 Lee ..... A61F 13/51 604/385.03
2012/0010582 A1 1/2012 Newnam
2012/0071849 A1 * 3/2012 Kumar ..... A61F 13/4906 2/400
2012/0124712 A1 * 5/2012 Vanlandingham ..... B65D 75/5883 2/400
2013/0133121 A1 * 5/2013 Parker ..... A61F 13/505 2/69
2013/0172844 A1 * 7/2013 Coates ..... A61F 13/5633 604/394
2013/0191971 A1 * 8/2013 Collins ..... A61F 13/505 2/400
2014/0107602 A1 4/2014 Hamilton
2015/0141945 A1 * 5/2015 Emergi ..... A61F 13/47218 604/385.01
2020/0000155 A1 * 1/2020 Etienne ..... A61F 13/505
2020/0246203 A1 * 8/2020 Tulk ..... A61L 15/46
2020/0297556 A1 * 9/2020 Png ..... A61F 13/49006
2021/0106069 A1 * 4/2021 Aiello ..... A61M 35/10
2021/0177068 A1 * 6/2021 Karabetyan ..... A41B 9/023
2022/0240611 A1 * 8/2022 Campalans ..... A41C 3/0064
2022/0248777 A1 * 8/2022 Gilbert ..... A41D 1/088
2022/0313499 A1 * 10/2022 Clements ..... A61F 13/496
2023/0059401 A1 * 2/2023 Mellos ..... A61F 13/49003
2023/0083955 A1 * 3/2023 Robins ..... A61F 13/72 604/385.04
2023/0157376 A1 * 5/2023 Towns-Scott ..... A41D 1/089 2/406
2023/0263239 A1 * 8/2023 White ..... A41B 9/14 2/400
2023/0338206 A1 * 10/2023 Welch ..... A41D 31/102
2024/0065345 A1 * 2/2024 White ..... A41B 9/02

FOREIGN PATENT DOCUMENTS

WO WO-2007004826 A1 * 1/2007 ..... A41B 9/001
WO WO-2012047650 A1 * 4/2012 ..... A61F 13/49006
WO WO-2017180920 A1 * 10/2017 ..... A41B 9/023
WO WO-2022060629 A1 * 3/2022 ..... A41B 9/001
WO WO-2022096037 A1 * 5/2022
WO WO-2022229955 A1 * 11/2022

OTHER PUBLICATIONS

Ruby Love, retrieved from the Internet at https://www.rubylove.com/pages/how-it-works, on May 19, 2023 (available prior to Nov. 23, 2021)(4 pages).

* cited by examiner

MENSTRUAL GARMENT

TECHNICAL FIELD

The present invention relates to protective garments and more specifically, to washable menstrual undergarments.

BACKGROUND

Menstrual products have been evolving for as long as women have walked on Earth. More recently, washable or reusable menstrual products have (re-)gained popularity, spurred, in part, by the desire to preserve that same Earth by reducing waste and otherwise being more environmentally-friendly. For example, one existing product is a washable menstrual pad designed to be attached to regular undergarments, in place of disposable pads or liners. While the reusable nature of such product does help reduce waste, it does not solve the issue of menstrual leaks and staining that is also present with disposable products.

Another existing reusable product is a washable menstrual undergarment with a built-in pad or liner, designed to be used in place of regular undergarments. One drawback of such menstrual undergarments, however, is that the entire undergarment must be replaced when the built-in pad is at capacity. Moreover, such undergarments typically only include protective layers in a central region of the undergarment where a disposable pad would normal sit, thus leaving the rest of the garment prone to leaks and staining.

Other existing products include washable menstrual undergarments with a removable portion (i.e. pad or liner) that is both washable and replaceable. However, the removable portion tends to shift within the undergarment during wear and may even move out of place, especially during exercise or other physical activity. Moreover, the removeable portion only covers a limited, central region of the undergarment, such that these existing undergarments are also prone to menstrual leaks and staining.

Thus, there is still a need for a washable and reusable garment that is capable of absorbing fluid and preventing leakage of that fluid to outside the garment, and is particularly suited as a protective menstrual undergarment.

SUMMARY

An improved washable menstrual garment is provided herein. On the outside, the garment is made of fabric and generally looks like any standard pair of underwear. On the inside, an entire gusset area of the garment is lined with a second fabric that has been treated with a Durable Water Repellant (DWR) substance that helps to prevent fluids from soaking through the fabric to the outside of the garment. On top of the gusset fabric is a layer of moisture-wicking mesh fabric that lines the entire gusset area of the garment and is designed to hold an absorbent, removable liner or pad. In some embodiments, the mesh fabric covers the entire inside of the gusset from front to back, with an opening at the back waist for insertion of the removable liner. In other embodiments, the mesh fabric is comprised of two panels sewn together so that they partially overlap and leave an opening at a crotch area of the undergarment for receiving the removable liner. The liner comprises three layers of fabric that are sewn together and configured to collect and trap any fluids coming from the user, including menstrual fluids. The liner is sized and shaped to match, or substantially match, the length and width of the gusset area and to fit inside the mesh fabric layer against the gusset fabric. The mesh fabric layer is secured to the gusset fabric and the outer fabric layer using bartack stitching.

In one exemplary embodiment, a washable garment comprises a main portion configured to be worn on a lower body of a wearer, the main portion comprising an outer fabric layer, a gusset layer, and an inner fabric layer, each layer having a substantially similar length; and a removable portion coupled to the main portion between the inner fabric layer and the gusset layer, the removable portion configured to absorb fluids while worn against the lower body of the wearer, wherein the inner fabric layer includes an opening for receiving and removing the removable portion, and the removable portion is sized and shaped to extend substantially across a length and width of the gusset layer.

While certain features and embodiments are referenced above, these and other features and embodiments of the present invention will be, or will become, apparent to one having ordinary skill in the art upon examination of the following figures and detailed description. It is intended that all such additional embodiments and features included within this description, be within the scope of the present invention, and be protected by the accompanying claims.

BRIEF DESCRIPTION OF THE DRAWINGS

The present invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1A:
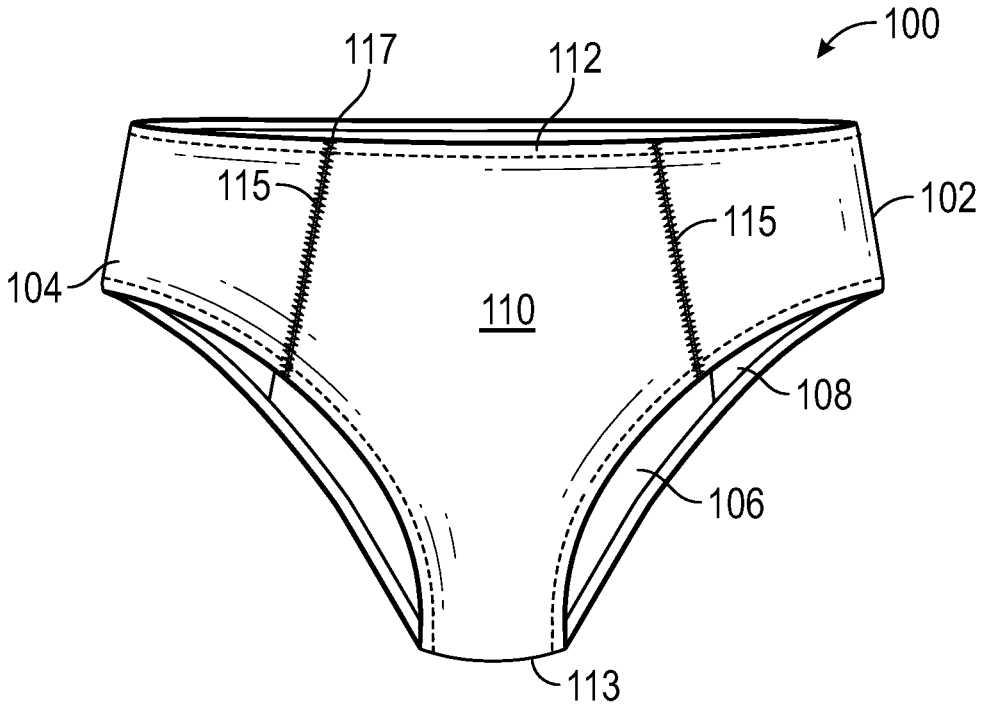
FIG. 1A is a front view of an exemplary washable garment, in accordance with embodiments.

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers or serial numbers in cases where such labeling facilitates a more clear description. Additionally, the drawings set forth herein are not necessarily drawn to scale, and in some instances proportions may have been exaggerated to more clearly depict certain features. Also, some of the drawings include partial views that have select parts removed for the sake of clarity with respect to the depicted portions. As stated above, this specification is intended to be taken as a whole and interpreted in accordance with the principles of the invention as taught herein and understood by one of ordinary skill in the art.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects.

Figure 1B:
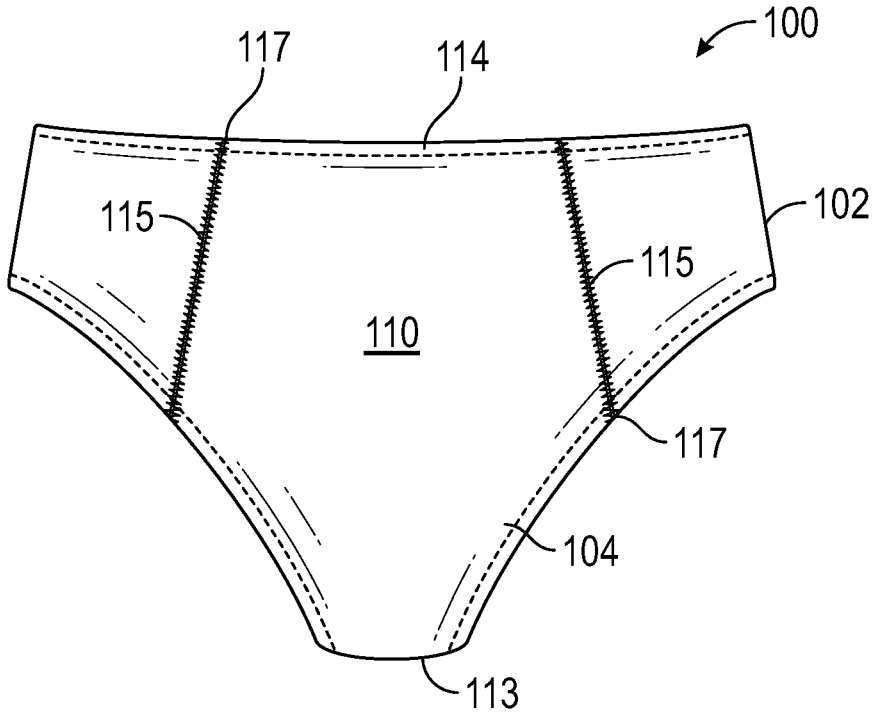
FIG. 1B is a rear view of the washable garment of FIG. 1A, in accordance with embodiments.

FIGS. 1A and 1B are front and back views of an exemplary washable garment 100, respectively, in accordance with embodiments. The washable garment 100 may be available in various sizes (e.g., XS to 3X). The garment 100 is preferably made of fabric and designed to be washed and reused multiple times. In the illustrated embodiment, the garment 100 (also referred to herein as a "menstrual garment") is a bikini, or bikini-style underwear. In other embodiments, the garment 100 may be any other type of undergarment, including, for example, a thong, briefs, boy shorts, or other underwear. In some embodiments, the garment 100 may be another type of clothing configured to be worn on a lower body of a wearer, including, for example, pants, leggings, shorts, skort (or skirt with integrated shorts), swimwear, leotard, tights, etc.

As shown in FIG. 1A, the garment 100 includes a main portion 102 configured to be worn on a lower body of a wearer (not shown). The main portion 102 defines the overall shape of the garment 100 and may also be referred to as the main body of the garment 100. The main body 102 comprises an outer fabric layer 104, a gusset layer 106, and an inner fabric layer 108. In embodiments, each of the layers 104, 106, and 108 may be substantially similar in length, as shown and described herein. As shown in FIGS. 1A and 1B, the outer fabric layer 104 extends across the entire main body 102 and is visible from the outside of the garment 100. In embodiments, the outer fabric layer 104 may be made of cotton, polyester, silk, or any other suitable material, alone or in any combination. In one exemplary embodiment, the outer fabric layer 104 is a fabric made of polyester and elastane (such as, e.g., JL Avantgarde Melodie).

Figure 2:
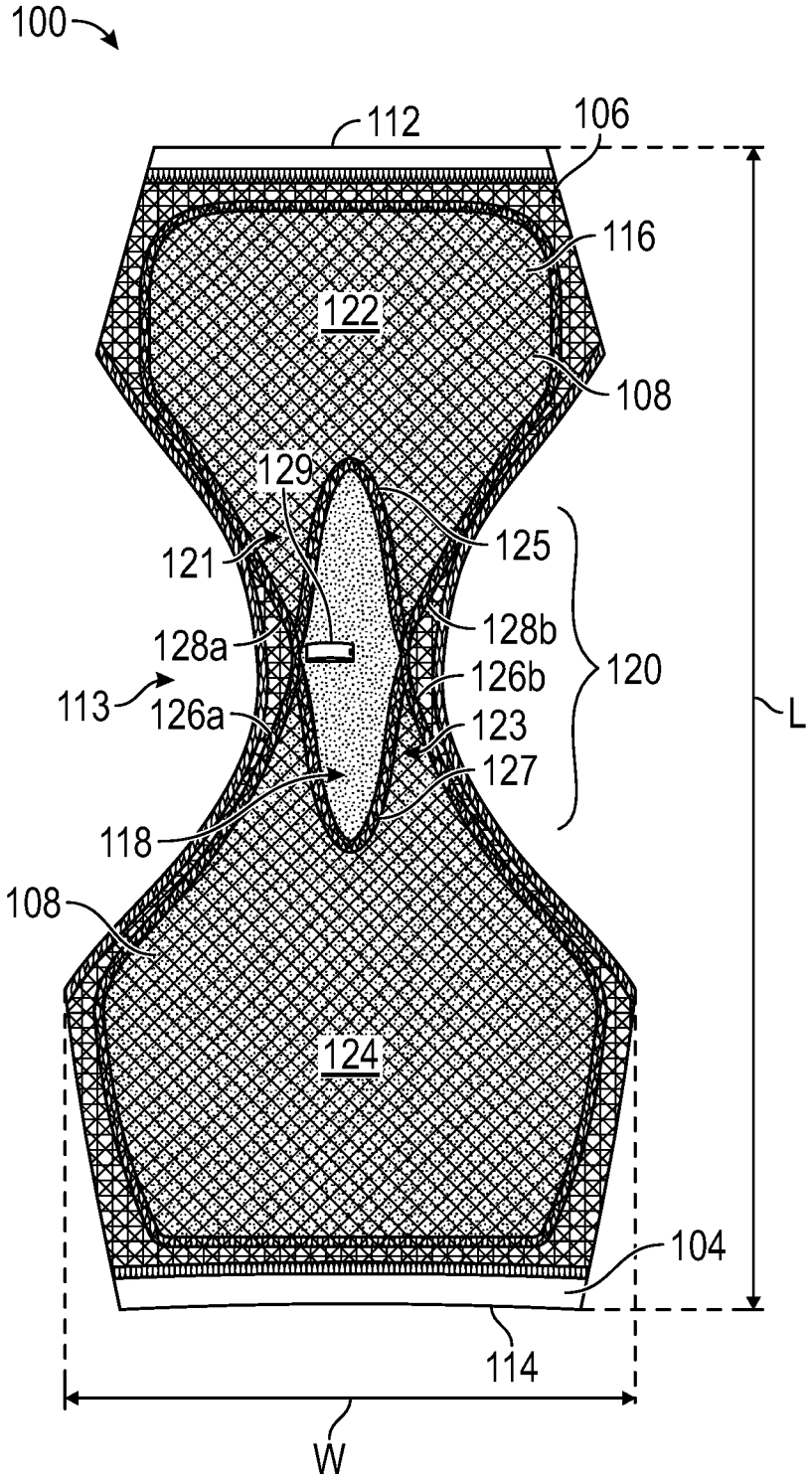
FIG. 2 is a top view of a gusset portion of the washable garment of FIG. 1A, in accordance with embodiments.
Figure 3:
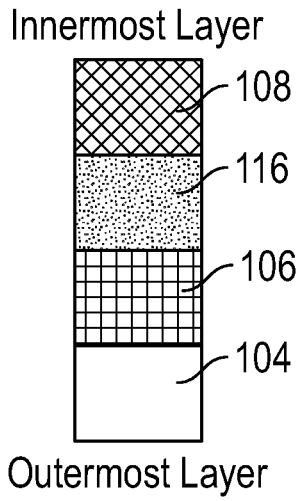
FIG. 3 is a cross-sectional view of the washable garment of FIG. 2, in accordance with embodiments.

Referring additionally to FIGS. 2 and 3, the gusset layer 106 comprises, or is lined with, a water-resistant and/or water-repellant substance, such as, e.g., Polyurethane Laminate (PUL) or other Durable Water Repellant (DWR) material, configured to prevent fluid from leaking through the gusset layer 106 and/or the outer fabric layer 104. In some embodiments, the gusset layer 106 may be a separate piece of fabric attached to an underside of the outer fabric layer 104. In other embodiments, the gusset layer 106 may be a substance disposed on the underside (or inner surface) of the outer fabric layer 104. In one exemplary embodiment, the gusset layer 106 is a fabric made of nylon, polyurethane, and Lycra (such as, e.g., Wazoodle ProSoft Stretch-Fit US190502-41354).

In embodiments, the gusset layer 106 is configured to extend across, or substantially cover, a gusset region 110 of the main body 102 and has a size and shape selected to substantially match a size and shape of the gusset region 110. For example, the gusset layer 106 can have a maximum length that is nearly or substantially equal to a maximum length, L, of the gusset region 110 and a maximum width that is nearly or substantially equal to a maximum width, W, of the gusset region 110, as shown in FIG. 2. The gusset region 110 extends, lengthwise, from a top front edge 112 of the garment 100, down the frontside of the garment 100 to a crotch panel 113 (as shown in FIG. 1A), across the crotch panel 113 to the backside of the garment 100, and up the backside to a top back edge 114 of the garment 100 (as shown in FIG. 1B). The gusset region 110 also spans, width-wise, across a central portion of the garment 100. As shown in FIGS. 1A and 1B, this central portion may be outlined by opposing seams 115 on both the frontside and the backside of the garment 100. In one exemplary embodiment, the gusset portion 110 has a width of about six inches along the top front edge 112, a width of about two and a half inches across the crotch panel 113, and a maximum width (W) of about six and a half inches along the top back edge 114, plus a maximum length (L) of about seventeen inches from top front edge 112 to top back edge 114. As will be appreciated, the actual dimensions of the gusset portion 110 will vary depending on the overall size of the garment 100 and the type of garment 100.

Figure 4:
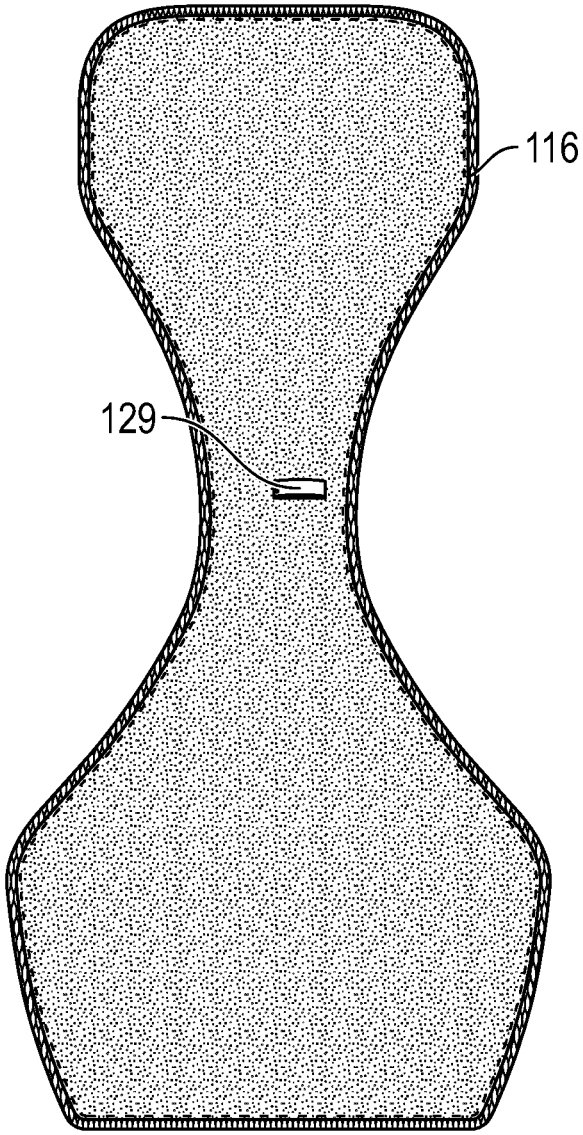
FIG. 4 is a bottom view of a removable liner of the washable garment of FIG. 2, in accordance with embodiments.

Referring additionally to FIGS. 4 and 5, the garment 100 further comprises a removable portion 116 coupled to the main body 102 between the inner fabric layer 108 and the gusset layer 106. The removable portion 116 is an absorbent pad or liner configured to capture and/or absorb fluids while worn against the lower body of the wearer. The removable portion 116 can be sized and shaped to extend substantially across a length and width of the gusset layer 106, in order to provide maximum coverage for the wearer. Moreover, the removable portion 116 is washable and reusable and thus, may be removed from the main body 102 and replaced with another removable portion 116 (or pad), for example, after the first one becomes saturated.

The inner fabric layer 108 extends across the entire, or at least a substantial portion of, the gusset layer 106 and is disposed over the removeable portion 116 once it is installed in the main portion 102. Bartack stitches 117, or the like, are used to secure the inner fabric layer 108 to the gusset layer 106 and the outer fabric layer 104 along the seams 115, as shown in FIGS. 1A and 1B. In embodiments, the inner fabric layer 108 is configured to create a "pocket" against the gusset layer 106 for snugly receiving the removable portion 116 therein. This pocket also provides an opening 118 at the crotch panel 113 to facilitate replacement of the removable portion 116, including receiving and removing the pad and inserting a new pad.

According to embodiments, the inner fabric layer 108 is comprised of at least two mesh panels arranged to form an overlapping region 120 that creates the above-mentioned pocket and provides the opening 118. For example, in FIG. 2, the overlapping region 120 is formed by a first end 121 of a first mesh panel 122 at least partially overlapping with a second end 123 of a second mesh panel 124. As shown, the first end 121 includes a first central region 125 configured to form a "U" shape that opens towards the second mesh panel 124 and first side regions 126*a* and 126*b* (also referred to as "first flaps") that extend away from the top front edge 112 to form the sides of the U-shaped central region 125. Similarly, the second end 123 includes a second central region 127 configured to form a "U" shape that opens towards the first mesh panel 122 and second side regions 128*a* and 128*b* (also referred to as "second flaps") that extend away from the top back edge 114 to form the sides of the U-shaped central region 127. As shown in FIG. 2, the mesh panels 122 and 124 are arranged on the gusset layer 106 such that the first side regions 126*a* and 126*b* overlap with the second side regions 128*a* and 128*b*, respectively, on opposite sides of the crotch panel 113, thus forming the overlapping region 120. In addition, the mesh panels 122 and 124 are further arranged so that the U shapes of the first and second central regions 125 and 127 join together to form an oval, thus creating the opening 118.

In embodiments, the mesh panels 122 and 124 may be partially secured to the gusset layer 106 in order to create the pocket for receiving the removable portion 116. For example, in FIG. 2, the outer edges or borders of the first mesh panel 122 and the second mesh panel 124 are sewn or otherwise secured to the gusset layer 106 of the main body 102, while the inner edges of the first end 121 and the second end 123 are unattached from the gusset layer 106, thus creating the opening 118 and the pocket underneath it. In addition, the fabric around the opening 118 may be stitched with a flexible thread, or otherwise configured so that the opening 118 is springy or stretchy enough to expand, at least slightly, as the user inserts or removes the removeable portion 116, and retract to its original position once released, so as to keep the removable portion 116 securely in place behind the mesh panels 122 and 124 once inserted. As an example, a serger or top-stitching technique may be used to conceal the raw edges of the mesh panels 122 and 124 around the opening 118 with the flexible thread. In one exemplary embodiment, the overlapping region 120 has a length of about five inches in order to create an opening 118 that is large enough to receive the removable portion 116.

The inner fabric layer 108 (also referred to as a "mesh lining") is configured to retain the removable portion 116 within the main portion 102. For example, the mesh lining 108 and the removable pad 116 can be sized and shaped to have matching, or substantially matching, dimensions, so that the removable pad 116 fits snugly between the inner fabric layer 108 and the gusset layer 106. In addition, the inner fabric layer 108 can be made of a stretchy but sturdy fabric that can be pulled apart to reveal the opening 118 and allow insertion and removal of the removable pad 116 therethrough, but is also capable of retaining its original shape, to keep the pad 116 pressed against the gusset layer 106 and securely inside the main portion 102. The inner fabric layer 108 may also be configured to cause liquids or fluids to move quickly through the layer 108 and into the removable portion 116 below it. In one exemplary embodiment, the mesh panels 122 and 124 are made of polyester and Spandex (such as, e.g., T4003 Mesh Tricot).

As shown in FIGS. 3 and 4, the removable portion 116 may include a grabbing element 129 to facilitate removal of the pad from the main portion 102. In the illustrated embodiment, the grabbing element 129 may be an elastic loop that is large enough to receive a finger that may be used to lift and pull the pad 116 out of the mesh pocket. A backside of the loop 129 may be tacked down so that it lies flat against the back of the removable pad 116, as shown in FIG. 4. As will be appreciated, other types of grabbing elements 129 may also be used to facilitate removal of the pad 116, such as, for example, a pull tab or the like.

Figure 5A:
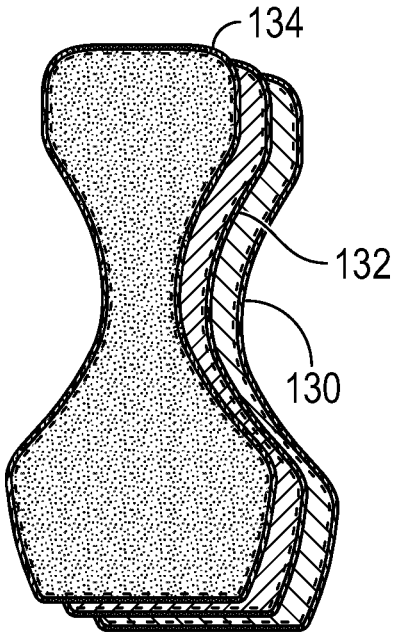
FIG. 5A is an exploded view of the removable liner of FIG. 4, in accordance with embodiments.
Figure 5B:
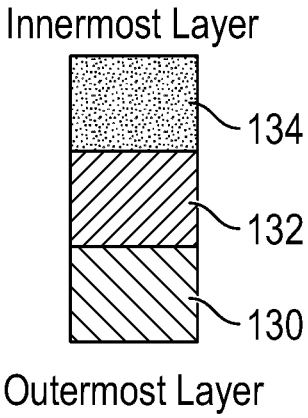
FIG. 5B is a cross-sectional view of the removable liner of FIG. 4, in accordance with certain embodiments.

Referring additionally to FIGS. 5A and 5B, the removable portion 116 includes a water-repellant layer 130, and an absorbent padding comprised of one or more fabric layers 132, 134. In one exemplary embodiment, the water-repellant layer 130 is comprised of PUL or DWR, and may be substantially similar to the gusset layer 106. In one exemplary embodiment, the absorbent fabric layers may include a first layer 132 comprised of Bamboo Viscose and Polyester (such as, e.g., ProECO Bamboo Sherpa Silver) and a second layer 134 comprised of silver (such as, e.g., Zorb 3D Poly Stay Dry Dimple Silver Fabric with SILVADUR). As shown, the water-repellant layer 130 may be the outermost fabric or layer of the removable pad 116, such that it resides against the gusset layer 106, and the second layer 134 may be the innermost fabric or layer of the pad 116, such that it resides against the mesh lining 108.

Figure 6:
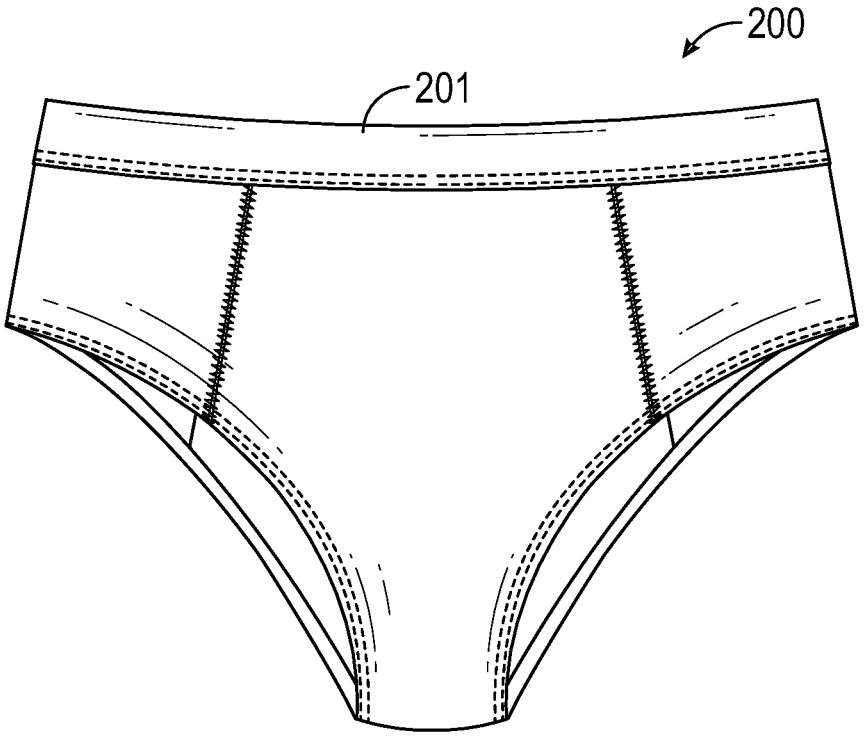
FIG. 6 is a front view of another exemplary washable garment, in accordance with embodiments.

FIG. 6 illustrates another exemplary washable undergarment 200 that may be substantially similar to the undergarment 100 of FIGS. 1A and 1B, except for the addition of a waistband 201, in accordance with certain embodiments.

Figure 7A:
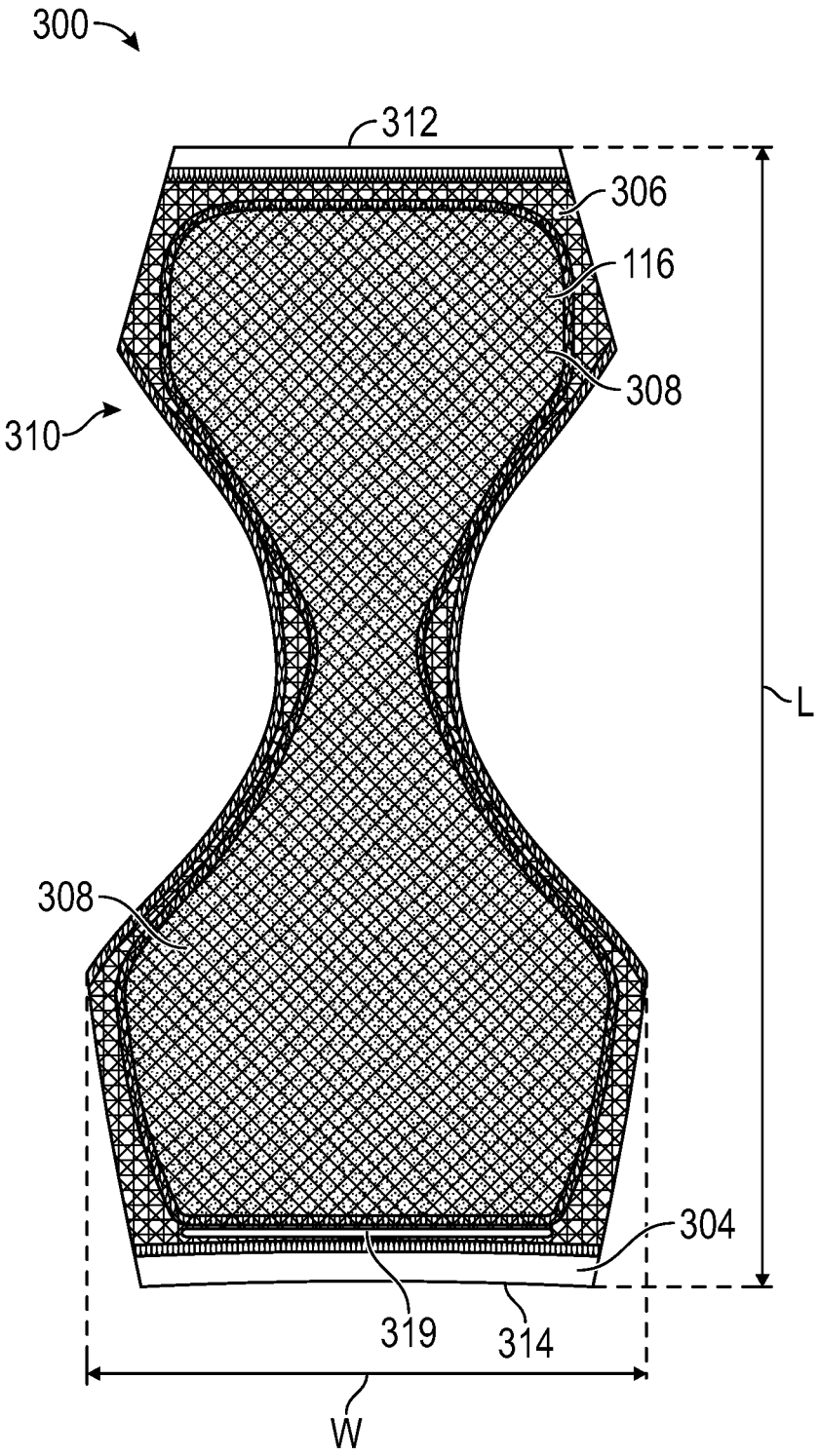
FIG. 7A is a top view of a gusset portion of another exemplary washable garment, in accordance with embodiments.
Figure 7B:
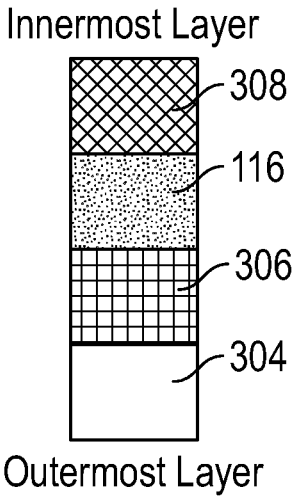
FIG. 7B is a cross-sectional view of the washable garment of FIG. 7A, in accordance with embodiments.

FIGS. 7A and 7B illustrate another exemplary washable undergarment 300 (also referred to herein as "garment"), in accordance with various embodiments. In general, the garment 300 may be substantially similar to all or portions of the undergarment 200 shown in FIG. 6 and/or the undergarment 100 shown in FIGS. 1A and 1B. For example, garment 300 may comprise a waistband like the waistband 201 shown in FIG. 6. As another example, FIG. 7B shows that the garment 300 is comprised of multiple layers of material, like the garment 100 shown in FIG. 3. In particular, the garment 300 comprises an outer fabric layer 304 that is substantially similar to the outer fabric layer 104 shown in FIGS. 1A and 1B, and a gusset layer 306 that is substantially similar to the gusset layer 106 shown in FIG. 2, the gusset layer 306 extending across, or substantially covering, a gusset region 310 of the garment 300, like the gusset layer 106. The garment 300 also comprises an inner fabric layer 308 made of moisture-wicking mesh fabric and configured to secure the removable portion 116 of FIG. 4 to the main body within a pocket formed between the inner fabric layer 308 and the gusset layer 306, like the inner fabric layer 108 shown in FIG. 2. For the sake of brevity, the components common to garments 100 and 300 will not be described in great detail herein.

Unlike the overlapping panels of the inner fabric layer 108, however, the inner fabric layer 308 is comprised of a one-piece mesh panel for creating said pocket for snugly receiving the removable portion 116 therein. In embodiments, the inner fabric layer 308 (also referred to herein as a "mesh lining") can be configured to entirely, or at least substantially, cover the gusset region 310, for example, by extending from a front of the gusset region 310 to a back of the gusset region 310. Moreover, instead of having the opening 118 at the crotch panel 113 of the garment 100, the inner fabric layer 308 can be configured to include, or form, an opening 319 for receiving and removing the removable portion 116 at or near an edge of the gusset region 310. As shown in FIG. 7A, the opening 319 may be formed from, or by, an edge of the inner fabric layer 308 that is located at the back of the gusset region 310, for example, near a top back edge 314 of the garment 300. In some embodiments, the opening 319 may be located at or near a back waistband of the garment or any other suitable location near the back of the garment 300. In other embodiments, the opening 319 may be formed from, or by, an edge of the inner fabric layer 308 that is located at the front of the gusset region 310, for example, near a top front edge 312 of the garment 300, a front waistband of the garment 300, or any other suitable location near the front of the garment 300. In still other embodiments, the opening 319 may be formed by an edge of the inner fabric layer 308 that is located at one side of the mesh panel, such as, e.g., along a left side or right side of the layer 308. In some embodiments, the garment 300 may include multiple openings 319, such as, for example, a first opening at or near the front of the gusset region 310 and a second opening at or near the back of the gusset region 310.

According to various embodiments, the opening 319 can be a slit or hole in the mesh lining 308 that is configured (e.g., sized and shaped) to create a space sufficient for insertion or removal of the removable portion 116, or other absorbent pad. For example, the opening 319 may have a width of about 5 to 6 inches in order to create a gap in the mesh lining 308 that is large enough to receive the removable portion 116. The remainder of the mesh lining 308 can be secured to the gusset layer 306 in order to create the pocket for receiving the removable portion 116, or other absorbent pad. In embodiments, the mesh fabric adjacent the opening 319 may be stitched with a flexible thread, or otherwise configured so that the opening 319 is springy or stretchy enough to expand, at least slightly, as the user inserts or removes the removeable portion 116, and retract to its original position once released, so as to keep the removable portion 116 securely in place behind the mesh lining 308 once inserted. As an example, a serger or top-stitching technique may be used to conceal the raw edges of the mesh fabric opening 319 with the flexible thread.

According to embodiments, the mesh lining 308 can be further configured to retain the removable portion 116 within the main body of the garment 300, like the inner fabric layer 108. For example, the mesh lining 308 and the removable pad 116 can be sized and shaped to have matching, or substantially matching, dimensions, so that the removable pad 116 fits snugly between the inner fabric layer 308 and the gusset layer 306. In addition, the mesh lining 308 can be made of a stretchy but sturdy fabric that can be pulled apart to reveal the opening 319 and allow insertion and removal of the removable pad 116 therethrough, but is also capable of retaining its original shape, to keep the pad 116 pressed against the gusset layer 306 and securely inside the main body of the garment 300. The mesh lining 308 may also be configured to cause liquids or fluids to move quickly through the inner fabric layer 308 and into the removable portion 116 below it. In one exemplary embodiment, the mesh lining 308 is made of polyester and Spandex (such as, e.g., T4003 Mesh Tricot).

Thus, a washable menstrual undergarment is provided that differs from existing products at least in that the inside of the undergarment, itself, is the interlocking mechanism between the mesh fabric and the removable pad. In particular, the mesh fabric is made in such a way that is covers the entire inside of the gusset area from front to back, and the shape and dimensions of the mesh pocket and removable pad made to be substantially the same in order to create pieces that fit snugly together. As a result, the removable pad is locked in place once it is inserted into the mesh pocket. Moreover, unlike other existing products, the removable pad described herein covers the wearer entirely from front to back, thus providing more coverage and protection from leaks. Also unlike existing products, the removable pad includes a finger sized loop for easy removal of the pad when needed.

It will be understood by those skilled in the art that various changes may be made and equivalents may be substituted without departing from the scope of the novel and non-obvious techniques disclosed in this application. Therefore, it is intended that the novel teachings of the present invention not be limited to the particular embodiment disclosed, but that they will include all embodiments falling within the scope of the appended claims.

What is claimed is:

1. A washable garment, comprising:

a main portion configured to be worn on a lower body of a wearer, the main portion comprising:

a gusset region configured to extend from a front top edge of the main portion to a back top edge of the main portion, and an outer fabric layer at least partially secured to an inner fabric layer, each layer configured to extend across at least a substantial portion of the gusset region; and a removable portion coupled to the main portion between the inner fabric layer and the outer fabric layer and configured to absorb fluids, the removable portion sized and shaped to extend at least substantially across a length and width of the gusset region, wherein the inner fabric layer comprises a first opening for receiving and removing the removable portion, the first opening located at or near a select one of the front top edge and the back top edge of the main portion.

2. The washable garment of claim 1, wherein the inner fabric layer is configured to retain the removable portion within the main portion.

3. The washable garment of claim 1, wherein the inner fabric layer and the outer fabric layer are configured to form a pocket for retaining the removable portion therein.

4. The washable garment of claim 1, wherein the inner fabric layer is comprised of a mesh panel configured to cover the gusset region from a front of the gusset region to a back of the gusset region, the first opening being formed by an edge of the inner fabric layer.

5. The washable garment of claim 1, wherein the first opening is located at or near a waistband of the main portion.

6. The washable garment of claim 1, wherein the removable portion comprises a grabbing element to facilitate removal of the removable portion from the main portion.

7. The washable garment of claim 1, wherein the outer fabric layer comprises a water-repellant substance.

8. The washable garment of claim 1, wherein the removable portion includes a water-repellant layer and an absorbent padding comprised of one or more fabric layers, the water-repellant layer residing against the outer fabric layer of the main portion.

9. The washable garment of claim 1, wherein the inner fabric layer further comprises a second opening for receiving and removing the removable portion, the second opening located at or near the other one of the front top edge and the back top edge of the main portion.

10. The washable garment of claim 1, further comprising a front waistband and a back waistband, wherein the gusset region extends from the front waistband to the back waistband, the first opening located at or near the front waistband and the second opening located at or near the back waistband.

* * * * *